United States Patent [19]

Hunter

[11] Patent Number: 4,867,379

[45] Date of Patent: Sep. 19, 1989

[54] ROTARY STREAM SPRINKLER UNIT

[76] Inventor: Edwin J. Hunter, 5551 Codorniz Rd., Rancho Santa Fe, Calif. 92067

[21] Appl. No.: 878,591

[22] Filed: Jun. 26, 1986

[51] Int. Cl.[4] ..... B05B 3/04

[52] U.S. Cl. ..... 239/240; 239/DIG. 1; 239/396

[58] Field of Search ..... 239/DIG. 1, 228, 230, 239/240, 396, 520

[56] References Cited

U.S. PATENT DOCUMENTS 1,831,540 11/1931 Nelson ..... 239/DIG. 1
2,270,595 1/1942 Lewis ..... 239/DIG. 1
3,854,664 12/1974 Hunter ..... 239/240
4,471,908 9/1984 Hunter ..... 239/DIG. 1

*Primary Examiner*—Kenneth J. Dorner
*Assistant Examiner*—Gerald A. Anderson
*Attorney, Agent, or Firm*—Baker, Maxham, Jester & Meador

[57] ABSTRACT

A rotary stream sprinkler unit comprises a body having a water flow passage in which is disposed a multi-passage flow control unit having a plurality of passages, each configured to control the volume and pressure of a stream with multiple outlets at the outlet end of the housing, and a rotary distributor cap rotatably mounted at the outlet of the housing for rotating each of the outlet streams through a selected arc during the rotation thereof.

19 Claims, 3 Drawing Sheets

ROTARY STREAM SPRINKLER UNIT

BACKGROUND OF THE INVENTION

The present invention relates to sprinkler units, and pertains particularly to a rotary stream sprinkler unit.

In my prior U.S. Pat. No. 3,854,664, issued Dec. 17, 1974, and, entitled "SPRINKLER SYSTEMS", I disclose a sprinkler unit which directs a plurality of rotating streams over an area to be watered. In my prior device, the water flows through an orifice plate and into a rotating head having a plurality of tubular passages for directing the respective streams through a particular arc. The orifice plate of that prior device controls the arc of coverage and is engaged by the rotating head as it rotates to distribute the water.

Among the problems of the prior device is that sand and grit from the water supply get on the orifice plate and rapidly wear the plate and seals of the unit. In some instances, the sand and grit can cause the unit to stall. These and other problems of the prior device have prevented it from being satisfactory.

Accordingly, it is desirable that an improved rotary stream sprinkler unit be available.

SUMMARY AND OBJECTS OF THE INVENTION

It is therefore the primary object of the present invention to provide an improved rotary stream sprinkler unit.

In accordance with the primary aspect of the present invention, a rotary stream sprinkler unit comprises a housing, having a flow passage having a plurality of stream passages, having means for providing a predetermined stream, volume and velocity with an open channel rotor positioned at the outlet of the flow divider for selectively distributing the streams over a predetermined area.

BRIEF DESCRIPTION OF THE DRAWINGS

The above and other objects and advantages of the present invention will become apparent from the following description when read in conjunction with the drawings wherein.

Figure 12:
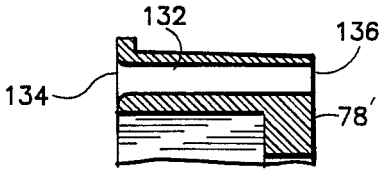
FIG. 12 is a view like FIG. 11 showing another flow passage.

FIG. is a view like FIG. 12 showing a further flow passage.

DETAILED DESCRIPTION OF A PREFERRED EMBODIMENT

Figure 1:
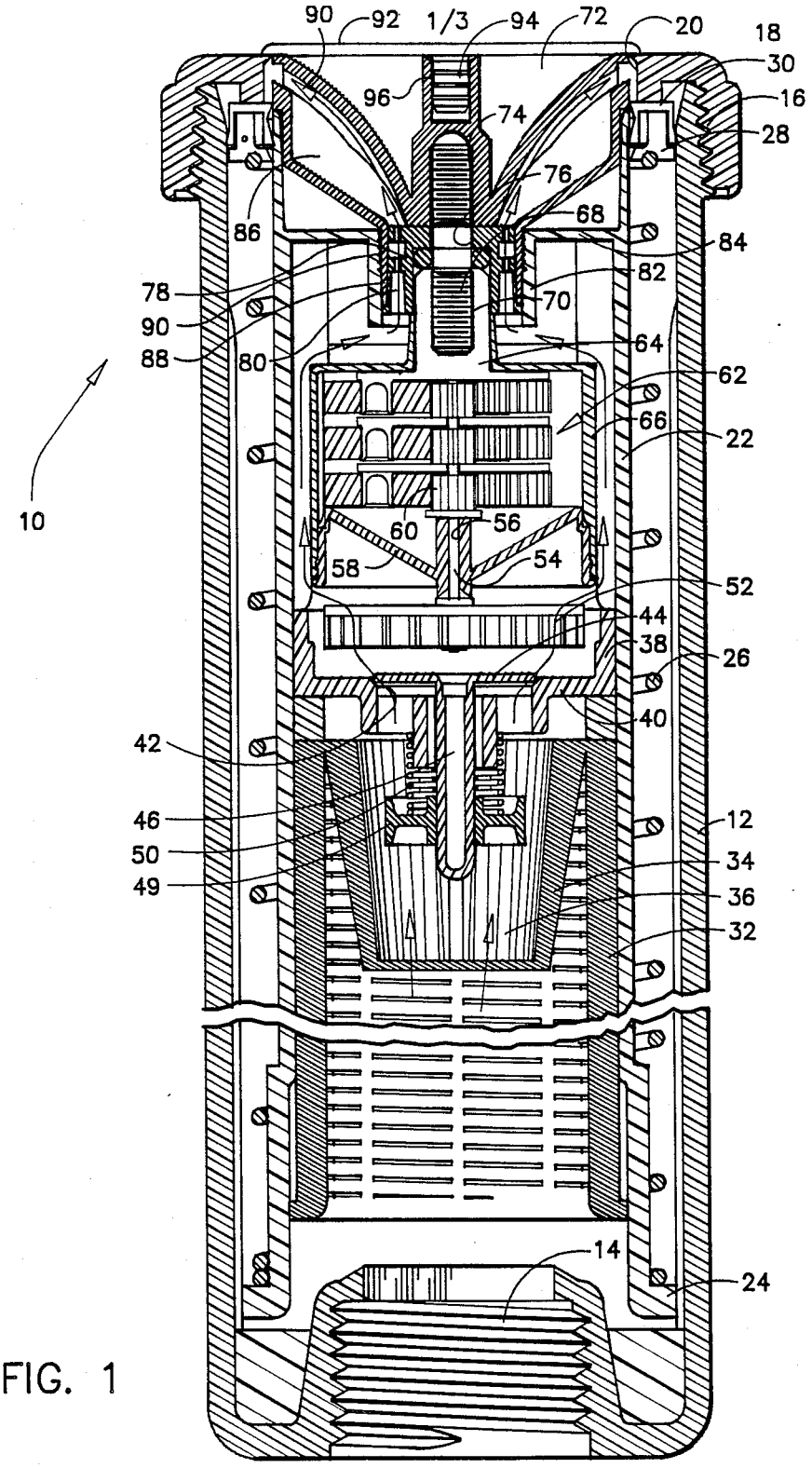
FIG. 1 is a side elevation view in section of a sprinkler unit in accordance with the invention.

Referring to FIG. 1 of the drawings, there is illustrated a sprinkler unit constructed in accordance with a preferred embodiment of the invention. The sprinkler unit, designated generally by the numeral 10, comprises an elongated generally cylindrical tubular housing 12, having a threaded inlet port 14 at one axial end, which shall be termed the lower end attachable to a suitable source of water under pressure, such as a riser.

The opposite or upper end of the housing is open and is called the outlet end thereof. The outlet end is provided with annular threads 16 for receiving a retainer cap 18, as will be explained. The cap 18 has a central bore 20 for accommodating the telescopic extension of an inner tubular housing 22, which is telescopically and reciprocably mounted within the housing 12 for extension to an operative position and retraction to a non-operative position, as illustrated in FIG. 1.

The inner housing 22 includes a radially extending flange 24 at the lower end thereof, which extends outward and engages the interior surface of the wall of the outer housing 12, and also serves as a retainer for a retracting spring 26, which biases at its lower end against the flange 24 and its upper end against an annular ring 28. The ring 28 seats against a cup-shaped annular seal 30, which engages the outer surface of the inner housing 22.

The driving and flow control structure for the sprinkler unit is mounted within the inner housing 22 and carried therewith as the housing is extended upward into the operative position. Mounted within the lower end of the inner housing 12, within the tubular central bore thereof, is a sleeve 32 having a backward extending sleeve or tubular extension 34, forming a passageway 36 to a by-pass valve unit for causing a drop in pressure as the water flows past this point. This drop in pressure allows water to flow through tangential jets in wall 38 (not shown) and impinge on a turbine blade 52. As larger volumes of water are required for larger areas, excess flow is by-passed by valve 44. This device is called a variable stator, the stator being the device that directs the flow of water to power the turbine.

The sprinkler head must operate on or accommodate anywhere from one-half gallon per minute up to six gallons per minute. A device of this type is required to accommodate this wide variation in flow. This device is well known in the industry and is not considered a part of the invention.

The valve unit comprises a removable wall member, defined by a tubular extension 38, having an inwardly directed wall 40 and an opening 42 defining a valve seat, in which is seated a valve member having a disc 44 and an elongated stem 46 on which is mounted a retaining cap or disc 48 for retaining a coiled seating spring 50 in position for biasing the valve member to its normally closed position.

Disposed upwardly or above the valve member is a turbine drive unit comprising a turbine blade 52 drivingly mounted on a rotating shaft 54, which is rotatably mounted within a bore 56 of a housing member 58. A pinion gear 60 on the upper end of the shaft 54 drives a planetary gear unit 62 sealingly mounted within a housing 66, having an output shaft or extension 64 of the gear unit journaled in and extending from the housing 66 by way of a suitable journal.

The driven shaft 64 is drivingly connected by a threaded shaft 68 threadably connected by its lower end into a threaded bore 70 in shaft 64. The shaft 68 extends upward and is connected at the upper end of the threaded shaft 68 to a distributing cap 72 by means of a threaded bore 74. The turbine and reduction gearing may be constructed, as more fully illustrated and described in my aforementioned U.S. patent, which is incorporated herein by reference as though fully set forth.

The shaft 68 extends through a bore 76 in a flow control unit 78 having a plurality of flow control passages 80 therein. These flow control passages may be more appropriately termed nozzles since they act to shape and control the size and velocity of a stream of water flowing therethrough. The flow control unit 78 is mounted in a tubular extension 88 of a retaining cap 86, which threadably engages the cylindrical extension 82 of the inner housing 22 at a threaded portion 90.

The flow control unit 78, which will be further explained hereinafter, delivers streams of water to the distributing cap 72, which directs the streams of water by way of a plurality of flow channels radially outward from the sprinkler unit. A cap 92 includes an extension 94 extending into a bore 96 in the cap unit 72 for mounting the cover 92 thereon.

Figure 2:
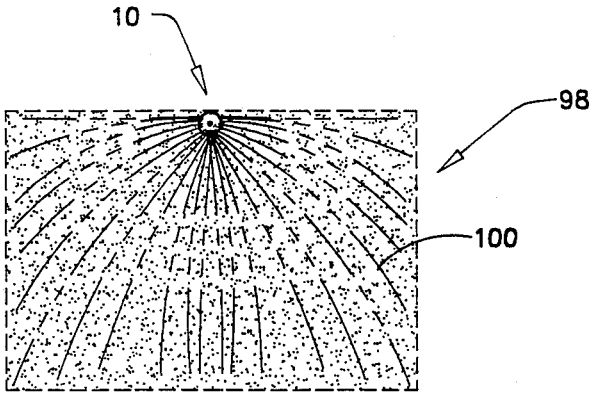
FIG. 2 a top plan view showing a typical area covered by a sprinkler unit in accordance with the invention.

The present sprinkler unit, as described above, is designed to distribute streams of water throughout a selected area. For example, referring to FIG. 2, the sprinkler unit has the capability of distributing streams of water over an area having a substantially rectangular shape, as illustrated in FIG. 2. The unit accomplishes this by means of the flow control unit which controls the volume and velocity of each flow stream, such that it has a particular reach, and the distributing cap has a capability of rotating each stream or sweeping each stream across a particular arc or area of the plot.

For example, as shown in FIG. 1, a plot or area 98 includes a plurality of individual streams directed outward therefrom from the sprinkler unit 10. A stream 100, for example, is directed outward at a particular angle from the sprinkler unit 10 and covers a particular arc of the plot 98, as will be explained with reference to the distributing cap.

Figure 3:
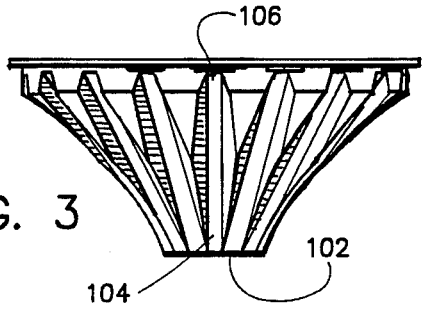
FIG. 3 is a side elevation view of the distributor head.
Figure 5:
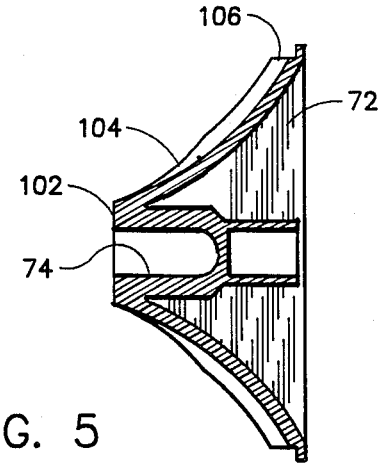
FIG. 5 is a side view in section of the distributor head of FIG. 3.
Figure 4:
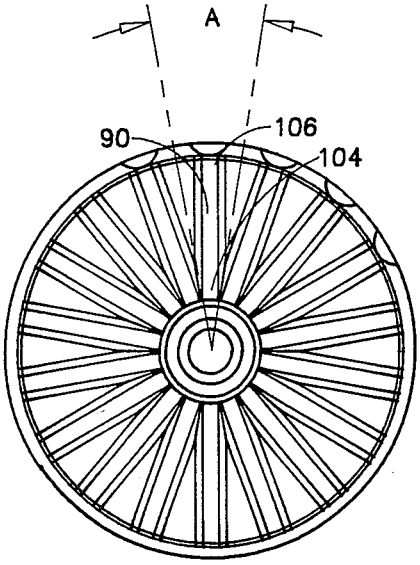
FIG. 4 is a bottom end view of the distributor head.

An appreciation for the operation of the distributor cap will be obtained from a view of FIGS. 3–5 and the following explanation herein. As shown in FIGS. 3–5, the distributor cap or head has a small diameter lower or inner end 102 and a larger diameter outer or top end 104 with a plurality of open water channels 90 extending therebetween. The water channel 90 includes an inlet end 104 and an outlet end 106 with sloped side walls extending, as can be seen from FIG. 5, from a minimum depth at the inlet end 102 to a maximum depth at the outlet 106. The cap, as can be seen in FIG. 1, sits directly over the flow control unit 78, and the inner or lower ends of the channels 102 are disposed directly over the outlet of the flow passages 80. As can be seen in FIGS. 3–5, the distributor head has a generally concave frusto-conical configuration with plurality of open channels extending both radially and axially among the outer surface thereof. The channels curve slightly outward from the axis and in a common plane therewith.

As will be appreciated from FIG. 4, an outlet of a stream passage is directed into the inner end of the flow channel 90, which is rotating with the rotating distributor cap. The rotation of the cap directs the outer end of the flow stream along an arc, as will be appreciated from FIG. 4. A flow stream that is directed into the inner end 104 of the flow channel 90 will continue to flow into that channel with a rotation of the cap along an arc A, as shown in FIG. 4. The length of the arc at the outer end will be determined by the radius from the center axis of the rotor to the position of striking of the surface by the stream at its outer end. Thus, for example, a stream may extend outward from approximately eight to about twenty-five feet, depending on the volume and velocity of the stream as it strikes the rotating cap. The arc of coverage may vary at the outer end of the stream from approximately three feet in length up to as much as nine or ten feet in length. Thus, as the distributing cap is rotating, it maintains communication with the flow passage for a certain degree of rotation thereof. As long as the inner end of the flow channel is in communication with a particular flow passage, the water from that flow passage will be directed along the flow channel 90 along an arc determined by where the inner end of the flow channel picks up the flow passage and where it drops that flow passage for the next one.

As the distributing cap rotates, a particular channel will in sequence pick up and distribute flow from each flow passage disposed around the flow control unit in sequence in the direction of rotation of the distributing cap. Thus, each flow stream will be in sequence picked up by the flow channel as it registers with that stream and will distribute it or direct it along an arc as the cap rotates. The length of the stream and its coverage of the surface area will be determined by the velocity and characteristics of the stream.

Figure 6:
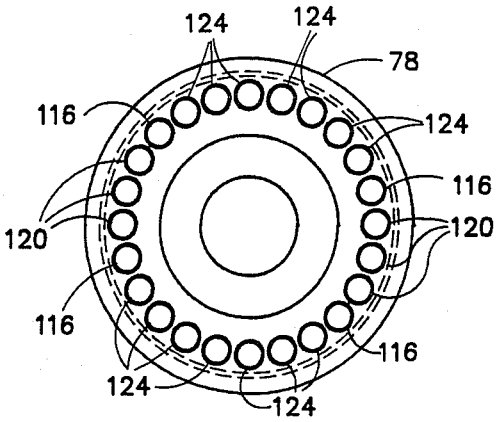
FIG. 6 is a bottom end view of the flow control unit showing the inlet ports.

Referring now to FIGS. 6–13, the construction and operation of the stream or flow control unit will be further explained. As shown in FIGS. 6–13 for illustrative purposes, a single flow modifying or control unit 78 is illustrated with a plurality of different flow modifying passages that will explain the principles of the invention. The inlet end of the flow control unit is illustrated in FIG. 6, showing the inlets to be substantially identical, will be substantially as shown at 110 and 116 in FIG. 8.

Figure 7:
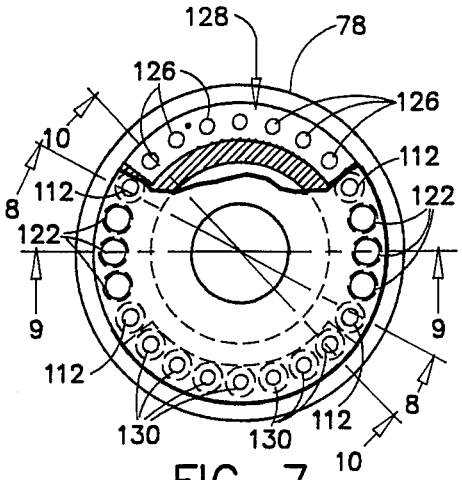
FIG. 7 is a top view of the flow control unit showing the outlet ports.

The outlet end of the unit 78 is shown in FIG. 7, with the outlet of the orifices or passages being shown to be different in size. As will be further explained, the configuration of the passage determines the volume and velocity of the stream. The distance achieved by a stream is a product of the volume and velocity of the water as it strikes the rotating distributor cap.

As pointed out above with reference to FIG. 6, the inlet end of the passages are essentially the same. This allows the use of a multiple pin plug for plugging selected ones of the passages. However, with reference for example to FIGS. 8 through 13, it is seen that the many passages differ in many features between the inlet and the outlet. They differ in bore size, bore length, bore shape, inlet shape, etc. These various parameters determine the size and velocity of the stream, which determines the reach or distance that the stream will have for a given pressure head. Thus, with proper selection of the passage parameters, various distribution patterns can be achieved.

Referring to FIG. 7, it will be seen that the flow control unit 78 is provided with bores or passages with different configurations. More particularly, it will be seen that the unit 78 is symmetrical about line 9—9, with directly opposite bores or passages formed identically. The unit 78 is initially configured to give a somewhat rectangular pattern with the sprinkler unit 10 located in the center of the plot. It can be easily configured to provide a rectangular plot, such as in FIG. 2, by plugging all passages on one side of the unit 78, with the remaining passages configured for the proper distribution.

Figure 8:
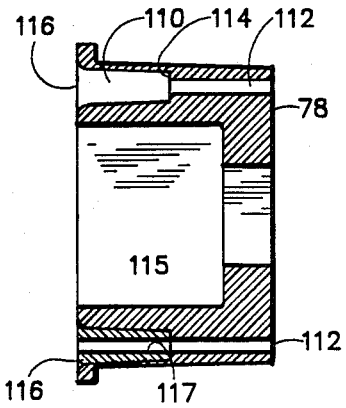
FIG. 8 is a section view taken on line 8—8 of FIG. 7.

Referring alternately between FIGS. 7 and 8, sets of shown. A stepped passage is illustrated with an enlarged passages 112, with a configuration, as shown in FIG. 8, are inlet section 110 with a sharply reduced outlet portion 112 with sharp shoulders 114 at the transition thereof. This sharply reduced outlet section determines the flow rate and its reach. The length of the passage being shorter than the length of the unit 78 provides a longer reach than a passage of the same size of greater length, such as the length of the combined passages 110 and 112. This configuration of passage also enables a modification of the passage, as shown in the bottom of FIG. 8. This bottom passage has been modified by means of an insert 115 inserted into the forward section 110 of the passage. This insert modifies the entire passage to the same diameter with a section 117 forming an extension of section 112. A flow through this passage will have a shorter reach than flow through the passage 110, 112 at the top of the FIG. 8 embodiment. The passage can also be modified by making the entrance to section 117, either rounded or sharp cornered. The rounded edge will provide a greater reach.

Figure 9:
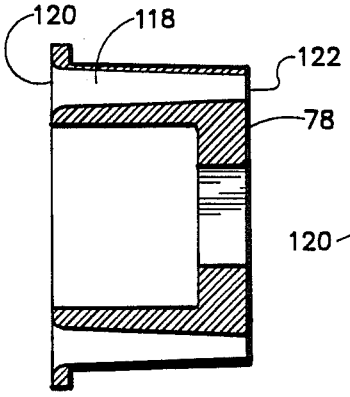
FIG. 9 is a view taken on line 9—9 of FIG. 7.

Referring to FIG. 9, a large streamlined passage 118 is illustrated, having a rounded or gradually curved inlet 120, and a gradually decreasing cross-section down to an outlet 122 only slightly smaller than the inlet 120. This configuration provides the most efficient stream of water and the maximum velocity to provide the greatest reach for a given size stream and pressure head. An identical passage 118, shown in FIG. 11, has a smaller diameter to deliver a smaller volume of water and reduces the distance or reach to a small extent.

Figure 10:
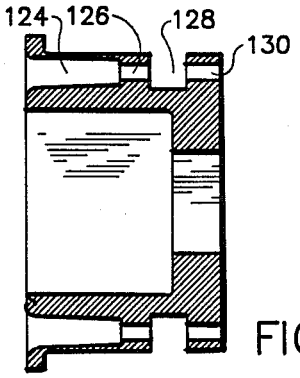
FIG. 10 is a view taken on line 10—10 of FIG. 7.

Referring to FIG. 10, an arrangement is illustrated wherein a passage 124 has the streamlined inlet, with a restricted portion 126, which is interrupted by a large intermediate section common to several passages and then out a restricted outlet 130. This discontinuous or interrupted passage results in considerable turbulence in the flow as it enters the outlet section 130 and provides a shorter reach than a passage 110, 112 of the same diameter. The inlet portion of this passage can also be modified by means of an insert 115 to provide a still different reach.

Referring to FIG. 12, a passage 132 has a streamlined inlet 134 with a uniform diameter to an outlet 136. This passage provides a slightly shorter reach than a passage 118 for example. Eliminating the streamlined inlet portion 134 and making the inlet with a sharp edge or corner would shorten the reach still further.

Figure 13:
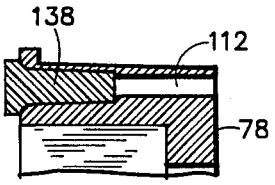

Referring to FIG. 13, a plug 138 is illustrated inserted into the passage 110 of a 110, 112 passage. This blocks the passage and renders it ineffective. Any of the passages may be similarly plugged to render any selected one or a multiple thereof ineffective.

Figure 11:
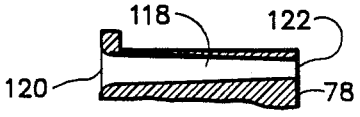
FIG. 11 is a section view showing an alternate flow passage.

In summary, the passages in order from maximum efficiency or distance to minimum is as follows: passage 118, 120, 122 of FIG. 9; passage 118, 120, 122 of FIG. 11; passage 132, 134, 136 of FIG. 12; passage 110, 116, 112 of FIG. 8; passage 117 modification of FIG. 8; passage 124, 126, 128, 130 of FIG. 10, and this last passage modified with 126 being smaller than 130.

The passages can thereby be selected and arranged in any suitable fashion to obtain a desired coverage of an area. For example, any number of different configuration passages may be provided in a particular flow unit. Similarly, any number of the passages can be modified by an insert 115 or plugged by means of a simple plug 138 to modify or provide flow through only certain of the passages This provides a number of modifications for obtaining a selected different area of coverage of the unit.

While I have illustrated and described my invention by means of a specific embodiment, it is to be understood that numerous changes and modifications may be made therein without departing from the spirit and scope of the invention as defined in the appended claims.

I claim:

1. A rotating stream sprinkler unit comprising:

an elongated tubular housing having a central axis, an inlet at one end, an outlet at the opposite end, and a flow passage communicating therebetween for conducting a flow of water from said inlet to said outlet;

means including a plurality of elongated flow control passages having an inlet end and an outlet end in said housing member disposed in a circular array around and extending along said axis toward the outlet for dividing said flow of water into a plurality of streams; and a rotating distributor head having an outer surface of a generally concave frusto-conical configuration rotatably mounted co-axially of said housing at said outlet, said head having an inner end defined by an apex adjacent the outlet of said flow passage, a plurality of symmetric flow channels formed in the outer surface of said distributor head individually receiving and directing each of said plurality of streams over a predetermined area as it passes over each passage.

2. A rotary stream sprinkler according to claim 1 wherein:

said flow channels on said distributor head are open channels curved radially outwardly in a common plane with said central axis.

3. A sprinkler unit according to claim 2 wherein:

a plurality of said passages differ in configuration for generating different velocity streams to said distributor head.

4. A sprinkler unit according to claim 3 wherein:

at least one of said passages has a uniform diameter throughout the length thereof.

5. A sprinkler unit according of claim 3 wherein:

at least one of said passages is defined by walls that are interrupted by a cavity between the ends thereof.

6. A sprinkler unit according to claim 3 wherein:

at least one of said passages has a progressively decreasing diameter from the inlet to the outlet thereof.

7. A sprinkler unit according to claim 3 wherein:

at least one of said passages has a sharp corner at the inlet thereof.

8. A sprinkler unit according to claim 3 wherein:

at least one of said passages has a rounded corner at the inlet thereof.

9. A sprinkler unit according to claim 3 wherein:

a plurality of said passages differ in configuration for generating different volume streams;

at least one of said passages has a uniform diameter throughout the length thereof;

at least one of said passages is interrupted by a cavity between the ends thereof;

at least one of said passages has a progressively decreasing diameter from the inlet to the outlet thereof;

at least one of said passages has a sharp corner at the inlet thereof; and at least one of said passages has a rounded corner at the inlet thereof.

10. A rotary stream sprinkler unit comprising:

an elongated generally cylindrical housing having coaxially disposed inlet and outlet means at opposite ends thereof;

a flow passage in said housing for communicating a fluid flow from said inlet to said outlet;

flow stream generating means comprising a plurality of elongated passages in said housing for generating a plurality of separate flow streams at said outlet, each of said elongated passages having a length that is at least twice the diameter thereof, at least one of said elongated passages having a different configuration for delivering a flow stream therefrom at a different distance than at least another of said plurality of said elongated passages;

a rotating distributor head having an axis and an inverted generally concave frusto-conical configuration with the apex thereof at said outlet, a plurality of open stream channels extending radially outwardly along the outer surface thereof in a common plane with said axis for receiving and directing each of said flow streams individually over selected areas; and drive means for driving said distributor head at a controlled rate of rotation.

11. A rotary stream sprinkler unit according to claim 10 wherein:

said plurality of flow passages are formed in an annular array in said cylindrical body member and extend along said cylindrical body member parallel to the axis thereof.

12. A sprinkler unit according to claim 11 wherein:

at least one of said passages has a uniform diameter throughout the length thereof.

13. A sprinkler unit according to claim 11 wherein:

at least one of said passages is defined by walls that define a cavity between the ends thereof.

14. A sprinkler unit according to claim 11 wherein:

at least one of said passages has a progressively decreasing diameter from the inlet to the outlet thereof.

15. A sprinkler unit according to claim 11 wherein:

at least one of said passages has a sharp corner at the inlet thereof.

16. A sprinkler unit according to claim 11 wherein:

at least one of said passages has a rounded corner at the inlet thereof.

17. A rotating stream sprinkler unit comprising:

an elongated generally cylindrical tubular housing having an inlet, an outlet, and a flow passage communicating therebetween for conducting a flow of water from said inlet to said outlet;

means comprising a plurality of elongated passages distributed in a circular array about the axis of said housing for dividing said flow of water into a plurality of streams at said outlet;

a rotating distributor head having an axis and a generally concave frusto-conical outer surface, a plurality of open flow channels in and extending generally axially along said outer surface, said distributor head rotatably mounted at said outlet for receiving said streams and directing said streams individually via said flow channels over a predetermined area; and a turbine in said flow passage responsive to flow of water therein for rotating said distributor head.

18. A sprinkler unit according to claim 17 wherein:

a plurality of said passages differ in configuration for generating different velocity streams.

19. A sprinkler unit according to claim 18 wherein:

at least one of said passages has a uniform diameter throughout the length thereof;

at least one of said passages includes an enlarged cavity between the ends thereof;

at least one of said passages has a progressively decreasing diameter from the outlet thereof;

at least one of said passages has a sharp corner at the inlet thereof; and at least one of said passages has a rounded corner at the inlet thereof.

* * * * *